US006767166B2

(12) United States Patent
Matsuura et al.

(10) Patent No.: US 6,767,166 B2
(45) Date of Patent: Jul. 27, 2004

(54) MOTION REDUCED FLOATING STRUCTURE

(75) Inventors: Masami Matsuura, Nagasaki-ken (JP); Makoto Ohta, Nagasaki-ken (JP); Shinkichi Tanigaki, Nagasaki-ken (JP); Takahiro Hirai, Nagasaki-ken (JP); Shuji Mizokami, Nagasaki-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/196,949

(22) Filed: Jul. 18, 2002

(65) Prior Publication Data

US 2003/0017009 A1 Jan. 23, 2003

(30) Foreign Application Priority Data

Jul. 19, 2001 (JP) ..... 2001-220700

(51) Int. Cl.[7] ..... E02B 3/26; B63B 39/06
(52) U.S. Cl. ..... 405/212; 405/211; 114/126
(58) Field of Search ..... 114/126, 121, 114/125; 405/211, 212

(56) References Cited

U.S. PATENT DOCUMENTS 5,235,926 A * 8/1993 Jones ..... 114/126
6,102,625 A * 8/2000 Olsen et al. ..... 405/195.1
6,408,780 B1 * 6/2002 Ozaki et al. ..... 114/264
6,487,982 B2 * 12/2002 Takahashi et al. ..... 114/121

FOREIGN PATENT DOCUMENTS

| | | | |
|---|---|---|---|
| FR | 1417153 | 11/1965 | |
| JP | 58081888 | 5/1983 | |
| JP | 61119489 A * | 6/1986 | ..... B63B/39/06 |
| JP | 2000-135999 | 5/2000 | |

* cited by examiner

*Primary Examiner*—Jong-Suk Lee
*Assistant Examiner*—Lisa M. Saldano
(74) *Attorney, Agent, or Firm*—Oblon, Spivak, McClelland, Maier & Neustadt, P.C.

(57) ABSTRACT

A motion reduced floating structure includes a main hull structure and a wave damping structure connected with the main hull structure. The wave damping structure may include a back board, a lower horizontal board and vertical members. The back board is connected with the main hull structure, and the lower horizontal board is connected with a lower portion of the back board to extend in a horizontal direction and is under a seawater surface in case of mooring. The vertical members are connected with the lower horizontal board and the back board. A vertical direction hole is provided for the lower horizontal board.

5 Claims, 13 Drawing Sheets

MOTION REDUCED FLOATING STRUCTURE

BACKGROUND OF THE INVENTION

1. Field of the Invention

The present invention relates to a motion reduced floating structure which has an L-type wave damping structure for motion reduction.

2. Description of the Related Art

A floating structure is known as a building for effective use of marine. In a ship to transport persons and goods, fuel cost reduction is a higher priority than prevention of a rotational motion and a translational motion. For this reason, a hemispherical structure is adopted as a bow shape to reduce wave resistance. In the floating structure which is moored at a predetermined position, the prevention of the motions on the horizontal plane is important. The motions on the horizontal plane are such as a translational motion in a horizontal direction, a rotation motion around a horizontal axis and a drift motion.

It is known in Japanese Laid Open Patent Application (JP-P2000-135999A) to attach a wave damping structure on the longer side portions of the floating structure. The wave damping structure has so-called L-type structure in which a vertical member extends from the longer side portion of the floating structure and a horizontal member extends from the end portion of the vertical member in the horizontal direction under the seawater surface. Thus, it is possible for the wave damping structure to reflect wave effectively. However, when the wave damping structure reflects the wave, the floating structure receives reaction force and the horizontal momentum of the floating structure changes largely. Thus, over-prevention of the motions on the horizontal plane degrades the mooring performance of the floating structure.

The motion prevention effect of the floating structure becomes effective if the wave damping structure is formed long into a direction orthogonal to a wave progress direction when the wavelength of the wave is long. Supposing that a horizontal board is in the bottom of the sea and that the wavelength is 200 m, the horizontal board length of 20 m is needed which is the length of 1/10 of the wavelength at least. The wave damping structure needs to be formed long irrespective of whether the floating structure is small or large. Therefore, the wave damping structure itself becomes large and makes mass large.

In the floating structure in which habitability and workability are important, the prevention of the motion around the horizontal axis is important primarily and the reduction of the translational motion in the horizontal direction is important secondarily. Both of the translational motion in the horizontal direction and the rotational motion around the horizontal axis depend on a wave period.

Also, there is a case that the translational motion becomes large when the rotation motion is suppressed. Therefore, it is important that the translational motion in the horizontal direction and the rotational motion around the horizontal axis are balanced, taking the wave period into account.

When it is planned to install the wave damping structure in an existing floating structure or an existing work ship, it is desirable that the wave damping structure is small and light in weight and that the structure is reinforced.

SUMMARY OF THE INVENTION

Therefore, an object of the present invention is to provide a motion reduced floating structure in which motions on a horizontal plane can be prevented.

Another object of the present invention is to provide a motion reduced floating structure, in which the prevention of the rotational motion around the horizontal axis and the prevention of the translational motion in the horizontal direction are balanced.

Another object of the present invention is to provide a motion reduced floating structure, which is small and light.

Another object of the present invention is to provide a motion reduced floating structure whose structure is reinforced.

In an aspect of the present invention, a motion reduced floating structure, includes a main hull structure and a wave damping structure connected with the main hull structure. The wave damping structure may include a back board, a lower horizontal board and vertical members. The back board is connected with the main hull structure, and the lower horizontal board is connected with a lower portion of the back board to extend in a horizontal direction and is under a seawater surface in case of mooring. The vertical members are connected with the lower horizontal board and the back board. A vertical direction hole is provided for the lower horizontal board.

Here, each of the vertical members may be formed of a triangular board to enforce the lower horizontal board and the back board.

The wave damping structure is provided for a portion of the main hull structure which receives wave.

In another aspect of the present invention, a motion reduced floating structure includes a main hull structure and a wave damping structure connected with the main hull structure. The wave damping structure includes a back board, an upper horizontal board, a lower horizontal board, and vertical members. The back board is connected with the main hull structure. The lower horizontal board is connected with a lower portion of the back board to extend in a horizontal direction. The vertical members are connected with the lower horizontal board, the upper horizontal board and the back board in at least a portion, such that a space formed by the upper horizontal board, the back board and the lower horizontal board is divided into a plurality of domains by the vertical members.

Here, each of the vertical members may extend in parallel to a longitudinal direction of the main hull structure, or may extend to intersect a longitudinal direction of the main hull structure.

Also, two of the vertical members may be used as inner vertical members to partition the space into three domains. In this case, the wave damping structure may further include a center front board provided to close a center domain of the three domains.

Also, other two of the vertical members may be connected with outer sides of the space as outer vertical members. In this case, the wave damping structure may further include a center front board provided to close a center domain of the three domains.

Also, a vertical direction hole may be provided for the lower horizontal board on both sides of the three domains. Also, a horizontal direction hole may be provided for each of the inner vertical members. In this case, it is desirable that the lower horizontal board is removed from a center domain of the three domains.

In another aspect of the present invention, a motion reduced floating structure includes a main hull structure and a wave damping structure connected with the main hull structure. The wave damping structure includes a back board, an upper horizontal board, a lower horizontal board, four vertical members and lids. The back board is connected with the main hull structure. The lower horizontal board is connected with a lower portion of the back board to extend in a horizontal direction and is under a seawater surface in case of mooring. The four vertical members are connected with the upper horizontal board, the lower horizontal board and the back board in at least a portion such that a space formed by the upper horizontal board, the back board and the lower horizontal board is divided into three domains by the vertical members. The lid is provided for each of both sides of the three domains to be closable in case of tow and openable in case of the mooring.

Here, a vertical direction hole is provided for the lower horizontal board on both sides of the three domains. Also, a horizontal direction hole is provided for each of the inner vertical members. In this case, the lower horizontal board is removed from a center domain of the three domains.

In another aspect of the present invention, a motion reduced floating structure includes a main hull structure and a wave damping structure connected with the main hull structure. The wave damping structure includes a back board connected with the main hull structure, an upper horizontal board, a lower horizontal board, two vertical members and a front vertical board. The lower horizontal board is connected with a lower portion of the back board to extend in a horizontal direction. The two vertical members are connected with the upper horizontal board, the lower horizontal board and the back board in at least a portion such that a domain is defined by the upper horizontal board, the back board and the lower horizontal board. The front vertical board is connected with the upper horizontal board, the lower horizontal board and each of the outer vertical members.

Also, a vertical direction hole may be provided for the lower horizontal board. Each of the vertical members may be openable in an outside direction.

In another aspect of the present invention, a motion reduced floating structure includes a main hull structure of a box type and a wave damping structure connected with the main hull structure. The wave damping structure includes a back board, a lower horizontal board, vertical members, and a vertical direction hole. The back board is connected used as one side board of the main hull structure. The lower horizontal board is formed by extending a lower horizontal board of the main hull structure and which is connected with a lower portion of the back board to extend in a horizontal direction. The vertical members are connected with the lower horizontal board and the back board. The vertical direction hole is provided for the lower horizontal board.

Also, the wave damping structure further may include an upper horizontal board which is formed by extending an upper horizontal board of the main hull structure. Each of the vertical members is connected with the upper horizontal board, in addition to the lower horizontal board and the back board in at least a portion such that a space formed by the upper horizontal board, the back board and the lower horizontal board is divided into a plurality of domains by the vertical members.

DESCRIPTION OF THE PREFERRED EMBODIMENTS

Hereinafter, a motion reduced floating structure of the present invention will be described in detail with reference to the attached drawings.

Figure 1:
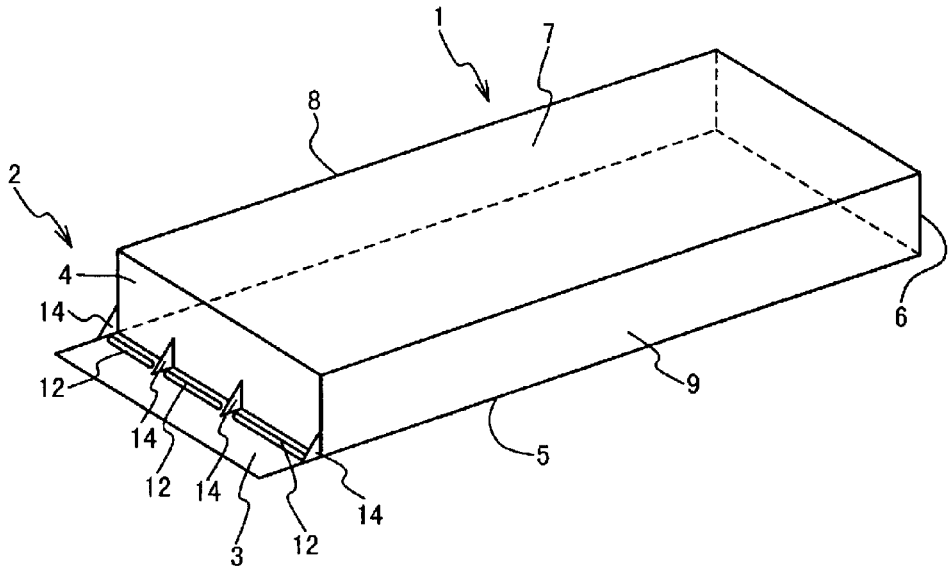
FIG. 1 is a perspective view showing a motion reduced floating structure according to a first embodiment of the present invention.

FIG. 1 shows the motion reduced floating structure according to the first embodiment of the present invention. Referring to FIG. 1, a motion reduced floating structure in the first embodiment is comprised of a main hull structure 1 having a rectangular parallelepiped box shape and a wave damping structure 2 provided on the wave incident side of the main hull structure 1. The main hull structure 1 is used independently in the installation state of the L-type wave damping structure 2 or as an element floating structure of a chain structured floating structure. The chain structured floating structure can be used as a marine leisure center, and a goods replenishment base in case of happening of a disaster.

The main hull structure 1 is comprised of a lower horizontal board 5 and an upper horizontal board 7 as an upper horizontal deck, longer side vertical boards 8 and 9 and shorter side vertical boards 4 and 6. The wave damping structure 2 is comprised of a horizontal board 3, the shorter side vertical back board 4, and triangular vertical enforcement plates 11. The horizontal board 3 has a hole 12 between two of the triangular vertical enforcement plates 11 in a portion close to the shorter side back board 4. That is, in the first embodiment, the wave damping structure 2 has of an L-type. Also, the shorter side back board 4 may be common to the shorter side vertical board of the main hull structure 1. The upper horizontal board 7 is located above the seawater surface. The lower horizontal board 5 and the horizontal board 3 are located below the seawater surface. The horizontal board 3 is welded to the lower portion of the back board 4 and extends from the back board 4 in a horizontal direction in the seawater. The horizontal board 3 may be formed by extending the lower horizontal board 5. In a region where the back board 4 and the horizontal board 3 intersect each other, the triangular vertical reinforcement boards 11 are welded to the back board 4 and the horizontal board 3 in a proper interval. The horizontal plane of the horizontal board 3 and the vertical plane of the back board 4 form an orthogonal concave section extending into the lateral direction. It is confirmed theoretically and experimentally that such an orthogonal concave section has a wave damping effect in the vertical direction. When the main hull structure 1 is used as a single unit, the L-type wave damping structures 2 may be installed in four sides of the main hull structure 1.

Here, a longitudinal direction is a direction orthogonal to the back board 4, and a lateral direction is a direction orthogonal to the longitudinal direction. The wave progresses toward the wave damping structure 2.

The horizontal board 3 receives the force of the wave in the vertical direction. Therefore, the different forces act on the upper surface and lower surface of the horizontal board 3. The difference between the forces has an opposite phase to the flotage acting on the lower surface in an end portion of the L-type wave damping structure 2. Such an opposite phase reduces the flotage in the end portion, reduces the wave force in the vertical direction, and suppresses motions of the main hull structure 1 on the horizontal plane in the end portion of the main hull structure 1 effectively.

In the orthogonal region where the horizontal board 3 and the back board 4 intersect each other, the plurality of vertical direction seawater passage holes 12 are provided in such a manner that seawater freely flows in or out between the upper surface and the lower surface in the horizontal board 3. The existence of the vertical direction seawater passage holes 12 reduces the coupling strength between the horizontal board 3 to the back board 4. However, the triangular vertical reinforcement boards 11 strengthen the coupling between the horizontal board 3 and the back board 4.

The vertical direction seawater passage holes 12 have a dynamic characteristic to decrease the suppression effect of the rotational motion around the horizontal axis. However, by making a part of the wave reflected by the back board 4 pass through the holes 12 in the vertical direction, the reaction force to the main hull structure 1 at the time of the reflection of the wave can be decreased so that the momentum change of the main hull structure 1 in the horizontal direction can be decreased. As a result, the motions of the main hull structure 1 on the horizontal plane such as a translational motion, a rotational motion, and a drift motion can be reduced.

The translational motion in the horizontal direction and a rotational motion around the horizontal axis are based on the area of the horizontal board 3, the length of the horizontal board 3 in the longitudinal direction, a distance from the horizontal board 3 to the surface of the seawater, a wave period, a wave amplitude, a total area of the vertical direction seawater passage holes 12, and the positions of the vertical direction seawater passage holes 12 as variables. The values of the variables are determined theoretically or in accordance with law of the experience such that the translational motion in the horizontal direction and rotational (roll and/or sway) motion around the horizontal axis become small.

Figure 2:
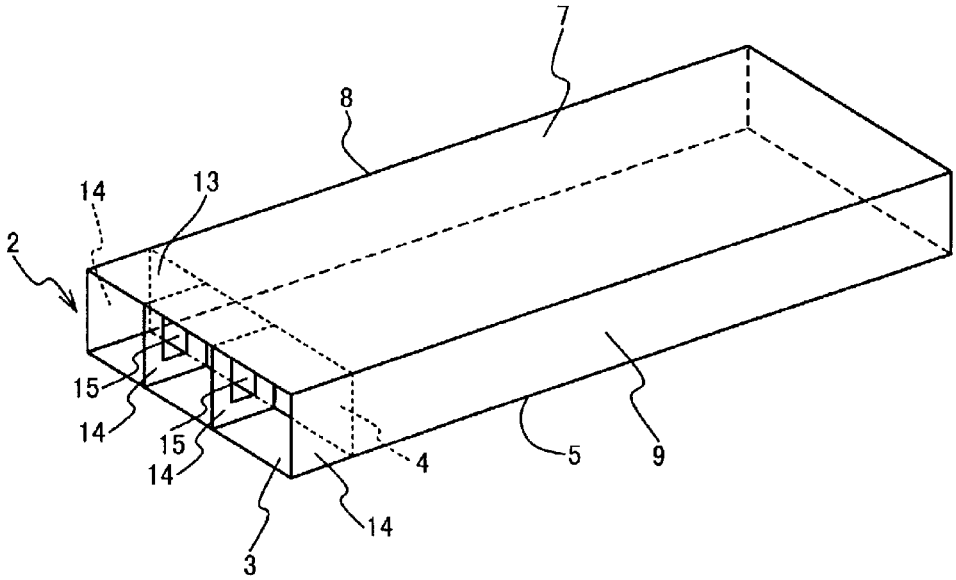
FIG. 2 is a perspective view showing the motion reduced floating structure according to a second embodiment of the present invention.

FIG. 2 shows the motion reduced floating structure according to the second embodiment of the present invention. The main hull structure 1 is same as that of the first embodiment. The wave damping structure 2 in the second embodiment is also attached to the main hull structure 1 on the wave input side. The wave damping structure 2 in the second embodiment is comprised of a lower horizontal board 3, a back board 4, an upper horizontal board 13, and a plurality of vertical partitioning boards 14. The upper horizontal board 13 is connected with the upper horizontal board 7 and extends from the upper end of the back board 4 into the longitudinal direction. The lower horizontal board 3 is connected with the lower horizontal board 5 and extends from the lower end of the back board 4 into the longitudinal direction. The lower horizontal board 3 may be formed by extending the lower horizontal board 5, and the upper horizontal board 13 may be formed by extending the upper horizontal board 7. The plurality of vertical partitioning boards 14 are interposed between the upper horizontal board 13 and the lower horizontal board 3. The vertical partitioning boards 14 are arranged in proper intervals, especially, in a constant interval into the lateral direction. If four vertical partitioning boards 14 are arranged, three domains are formed, each of which is surrounded with the upper horizontal board 13, the vertical partitioning boards 14 and the lower horizontal board 3. The outermost two of the vertical partitioning boards 14 may be formed by extending the longer side vertical boards 8 and 9, respectively.

The plurality of vertical partitioning boards 14 form a plurality of concave domains in the main hull structure 1.

The plurality of concave domains confine a surging wave divisionally and reflects the wave effectively. A horizontal direction seawater passage hole 15 is provided for each of the vertical partitioning boards 14 other than the outermost two, to diffract the wave in the lateral direction. The horizontal direction seawater passage holes 15 can suppress the rotational motion on the horizontal plane. It is effective to adjust the area of the horizontal direction seawater passage hole 15. Also, the vertical direction seawater passage holes 12 shown in the first embodiment may be provided for the lower horizontal board 3.

Figure 3:
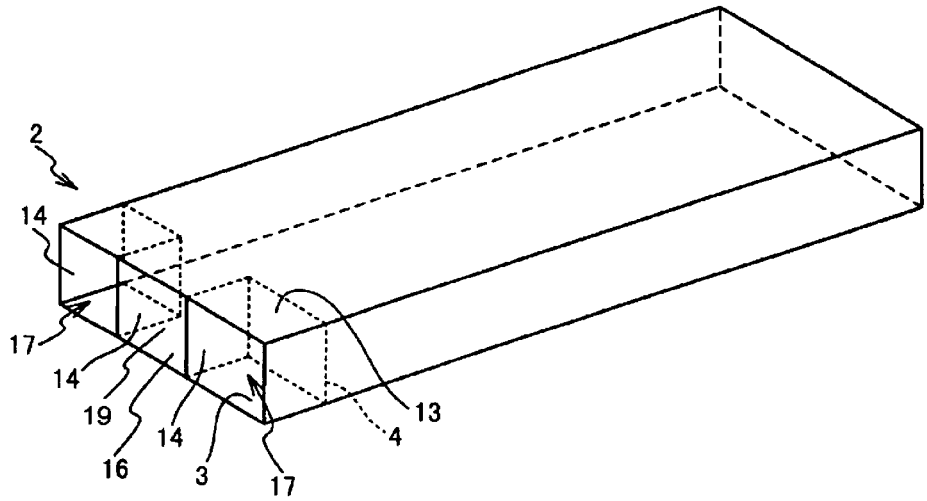
FIG. 3 is a perspective view showing the motion reduced floating structure according to a third embodiment of the present invention.

FIG. 3 shows the motion reduced floating structure according to the third embodiment of the present invention. In the third embodiment, the wave damping structure 2 of the third embodiment is comprised of two concave domains 17 on both sides and a center convex domain is arranged between the two concave domains 17. The center convex domain of the three domains is closed with a closure board 19. The closure board 19 is welded and combined with the outer ends of the center domain.

Figure 4:
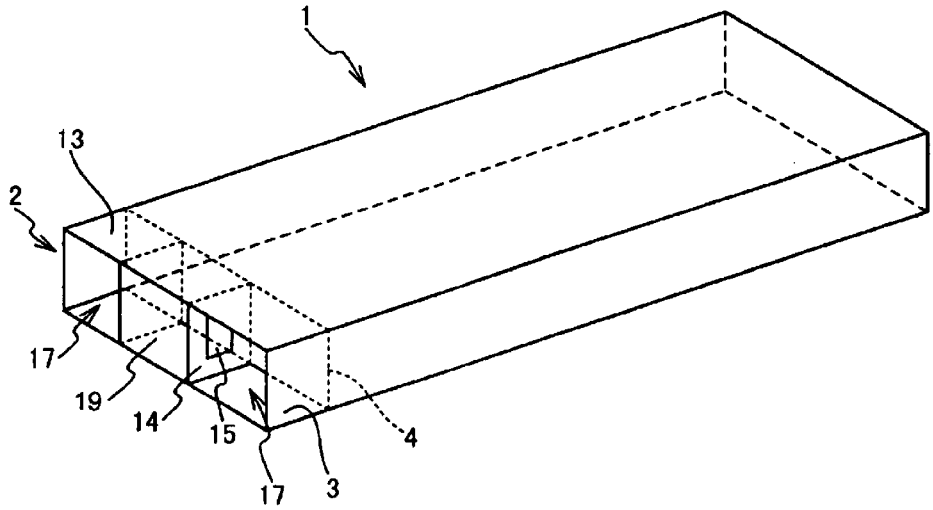
FIG. 4 is a perspective view showing the motion reduced floating structure according to a modification of the second embodiment of the present invention.

The concave domain 17 functions in the same way as the L-type wave damping structure shown in FIG. 1 or 2. The vertical direction seawater passage hole 12 shown in FIG. 1 may be opened in the concave domain 17. Moreover, as shown in FIG. 4, the lower horizontal board 3 in the center domain may be removed and a lateral direction seawater passage hole 15 may be formed in each of the vertical partitioning boards 14 of the convex domain, as shown in FIG. 2. Thus, an inverted L-type wave damping structure may be formed. In this case, both of the L-type structure and the inverted L-type structure have the suppression effect of the rotational motion around the horizontal axis. The L-type structure has the effect larger than the inverted L-type structure but the translational motion in the horizontal direction becomes large according to it. By combining and installing the L-type wave damping structure and the inverted L-type wave damping structure in a portion of the floating structure, the translational motion in the horizontal direction can be suppressed while maintaining the suppression effect of the rotation motion around the horizontal axis.

Figures 5A, 5B:
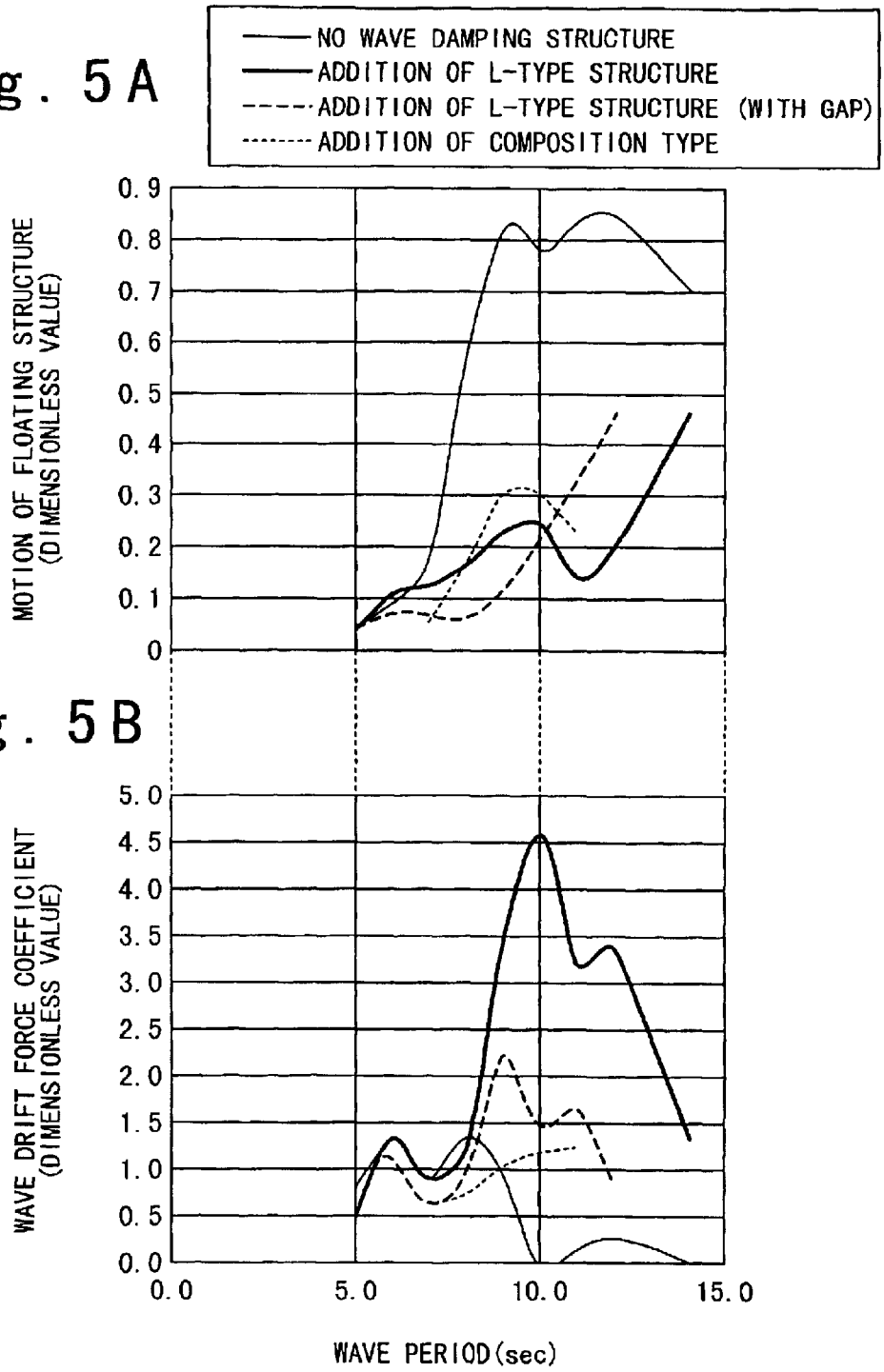
FIGS. 5A and 5B are graphs showing the motion of the floating structure and wave drift force coefficient in a plurality of models, respectively.

FIGS. 5A and 5B show a variety of the suppression effect of the rotational motion around the horizontal axis and the translational motion in the horizontal direction depending on the presence or absence of the L-type wave damping structure and the composition of the L-type wave damping structure and the inverted L-type wave damping structure. The vertical axis of FIG. 5A shows the motion of the floating structure (dimensionless value), and the vertical axis of FIG. 5B shows a wave drift force coefficient (dimensionless value). The horizontal axes of these figures show a wave period. FIGS. 5A and 5B show a tendency that the translational motion in the horizontal direction has an inverted phase to the rotational motion around the horizontal axis. Also, by providing a clearance gap 12, it is possible to balance the translational motion in the horizontal direction and the rotational motion around the horizontal direction.

Figure 6:
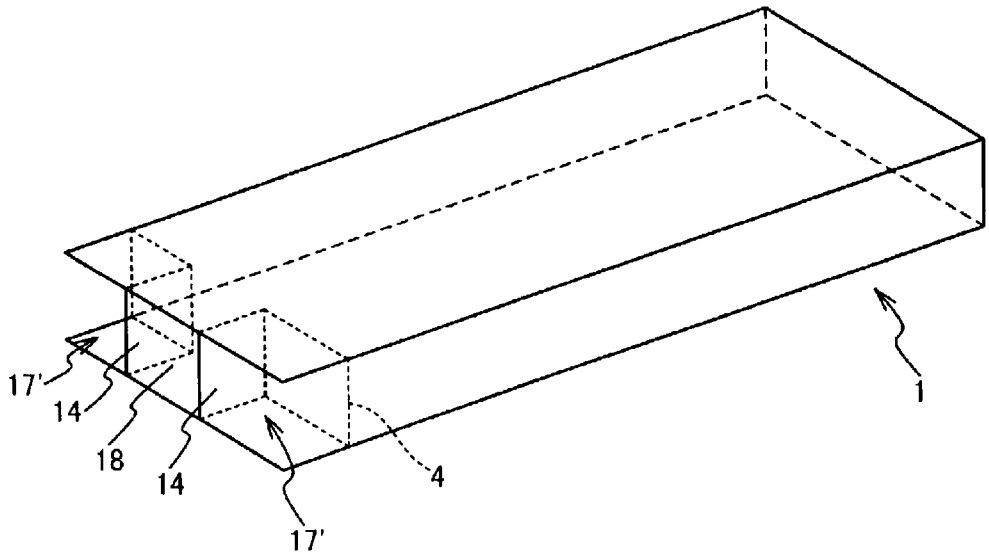
FIG. 6 is a perspective view showing the motion reduced floating structure according to a first modification of the third embodiment of the present invention.

FIG. 6 shows the motion reduced floating structure according to a first modification of the third embodiment of the present invention. In the first modification, the wave damping structure in the first modification is comprised of two concave domains 17' on both end portions and one convex domain 18 arranged between the two concave domains 17'. Thus, the vertical partitioning boards 14 in the outermost portions in the lateral direction are removed in the structure of FIG. 3. Each of the domains in the both end portions is formed of four boards, and portions corresponding to the outermost longer side vertical board 14 and outer shorter side board are opened.

The concave domain 17' has the L-type wave damping structure. One or more vertical direction seawater passage holes 12 shown in FIG. 1 may be provided in the concave domain 17'. Moreover, the horizontal direction seawater passage holes 15 shown in FIG. 2 may be provided in the vertical partitioning boards 14. In this case, it is desirable that the convex domain 18 is formed as the inverted L-type wave damping structure by removing the horizontal board 3 in the convex domain 18, and a back board 4 is provided for the main hull structure 1. Because the seawater flows into the convex domain 18, the back board 4 prevents the seawater from flowing into the main hull structure 1.

In the first modification, a component of the reflected wave in the lateral direction increases, compared with the case of FIG. 3. However, because the two concave domains 17' are symmetrically arranged with respect to the center convex domain 18, and the reflection of wave is symmetry, a total of reaction force of the wave becomes small. At this time, the suppression effect of the translational motion in the vertical direction is also improved.

Figure 7:
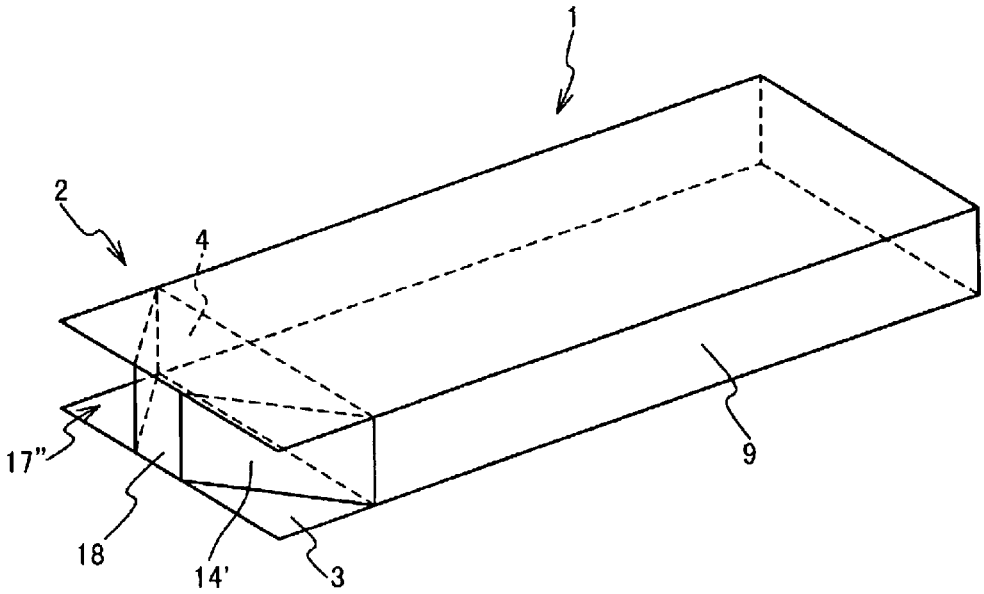
FIG. 7 is a perspective view showing the motion reduced floating structure according to a second modification of the third embodiment of the present invention.

FIG. 7 shows the motion reduced floating structure according to a second modification of the third embodiment of the present invention. In this embodiment, the vertical partitioning boards 14' are for the end portion of the main hull structure 1 in the longitudinal direction are formed to have an angle with respect to the longitudinal direction so that a convex portion is formed like a usual hull. Therefore, the horizontal board 3 in the concave domain 17" of FIG. 6 is not a square but is formed to be triangular. The vertical partitioning board 14' has a proper angle, preferably, 45 degrees with respect to the longitudinal direction. The closure board 18 is provided between the vertical partitioning boards 14' at the outermost portion. The back board 21 of the wave damping structure 2 is used as the shorter side board of the main hull structure 1.

The wave damping structure in the second modification is comprised of the concave domains 17" and the convex domain 18' between the concave domains 17" on both end portions. Surging wave is reflected into the lateral direction. At this time, the reflection of the wave in the lateral direction occurs more effectively than the embodiment of FIG. 6. Consequently, drift force (translational motion force in the horizontal direction) is more decreased. For this reason, it is meaningful to provide the vertical direction seawater passage holes 12 shown in FIG. 1 in the lower horizontal board 3 along the bottom line of the vertical partitioning board 14'. Also, it is more meaningful that the lateral direction seawater passage holes 15 shown in FIG. 2 are provided for the vertical partitioning boards 14', the back board 4 is provided, as shown in FIG. 7 and the lower horizontal board 3 in an area surrounded by the vertical partitioning boards 14', the back board 4 and the closure board 16 is removed.

Figure 8:
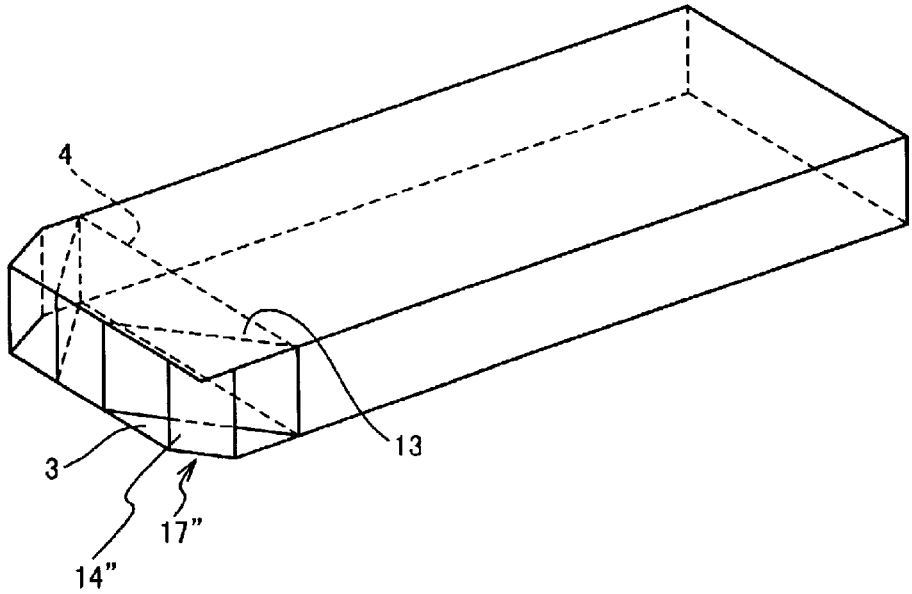
FIG. 8 is a perspective view showing the motion reduced floating structure according to a third modification of the third embodiment of the present invention.

FIG. 8 shows the motion reduced floating structure according to a third modification of the third embodiment of the present invention. In the third modification, as shown in FIG. 8, the concave domain 17" is formed. In the third modification, the corner of the triangular horizontal board 3 is cut off and an additional vertical partitioning board 14" is provided to enforce the horizontal board 3 and the upper horizontal board 13 in the outside portion of the concave domain 17".

Figure 9:
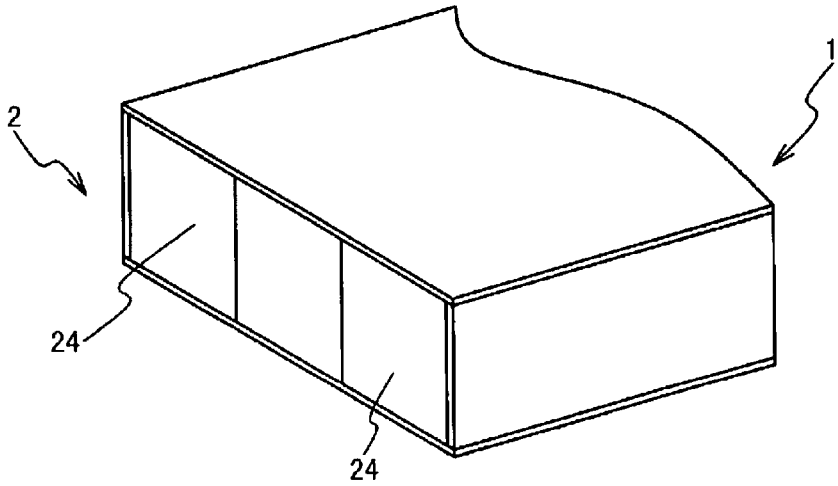
FIG. 9 is a perspective view showing the motion reduced floating structure according to a fourth modification of the third embodiment of the present invention in case of tow.
Figure 10:
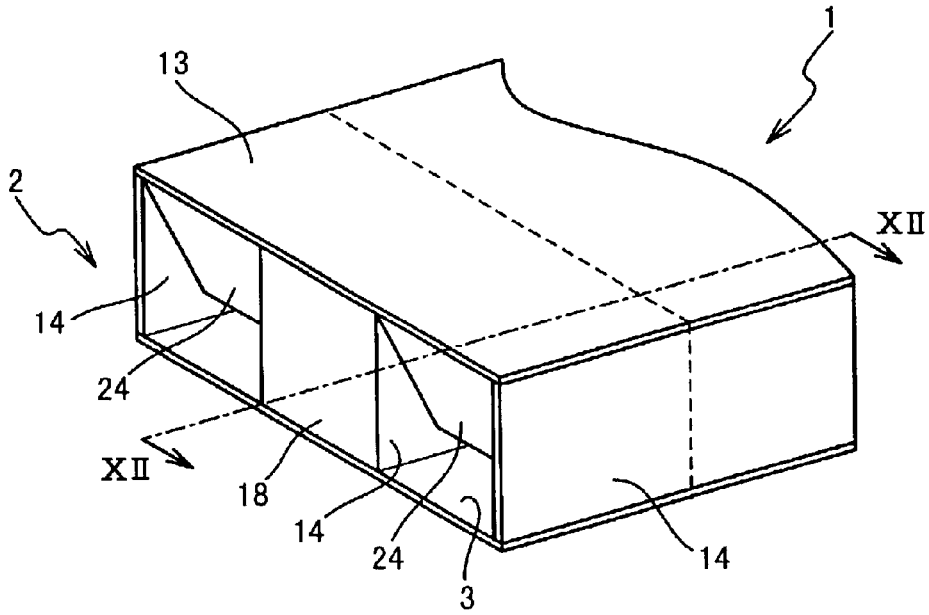
FIG. 10 is a perspective view showing an operation of the motion reduced floating structure according to the fourth modification of the third embodiment of the present invention in case of mooring.
Figure 11:
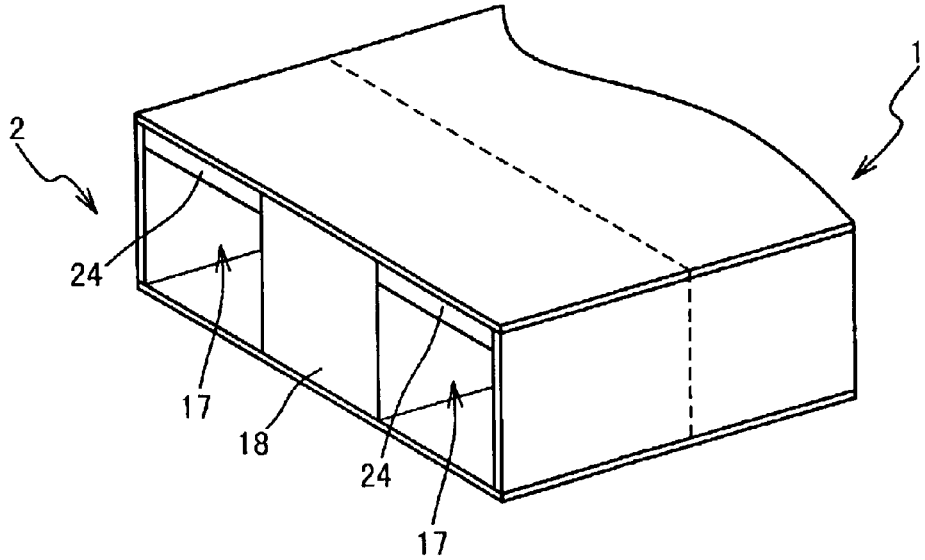
FIG. 11 is a perspective view showing an operation of the motion reduced floating structure according to the fourth modification of the third embodiment of the present invention in case of mooring.

FIG. 9 shows an outer appearance of a fourth modification of the third embodiment shown in FIG. 3 in the tow state. The concave domains 17 on both sides are closed down with a lid 24. FIG. 10 shows a state of the lid 24 on the way from the open position to the close position or from the close position to the open position. FIG. 11 shows the outer appearance of the state when the lid 24 is opened fully and the concave domain 17 is fully opened.

Figure 12:
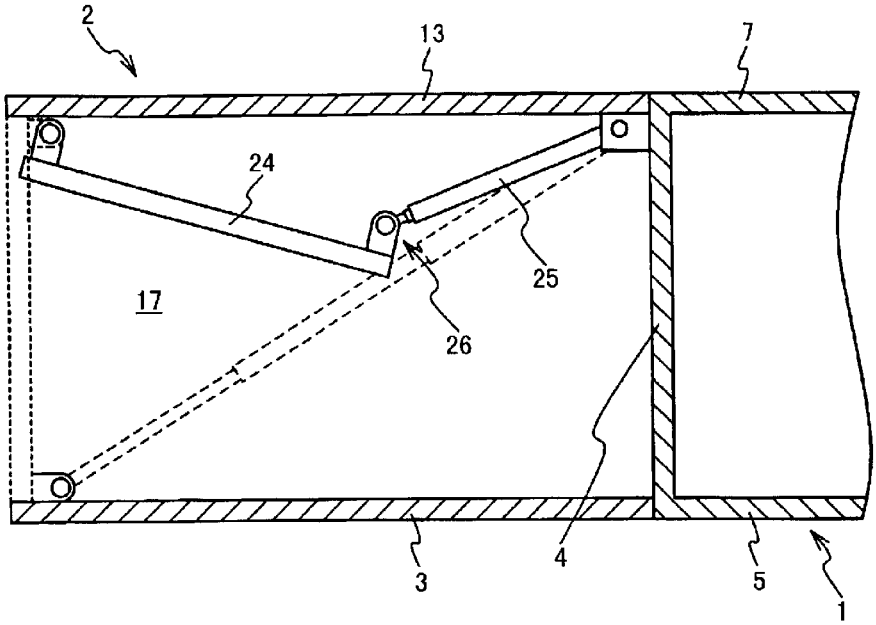
FIG. 12 is a cross sectional view showing a first example of an open and close mechanism of a lid in the motion reduced floating structure according to the fourth modification of the third embodiment of the present invention in case of mooring.

FIG. 12 is a cross sectional view of the floating structure along the XII-XII line of FIG. 10 to show a first example of an open and close mechanism of the lid 24. The proximal end of the lid 24 is turnably supported by a bearing which is fixed to the tip portion of the upper horizontal board 13 of the of L-type wave damping structure 2. The proximal end of a fluid pressure cylinder 25 is turnably supported by a bearing which is fixed to the proximal end of the upper horizontal board 13 close to the back board 4. The free end of the lid 24 is connected to the tip portion of the fluid pressure cylinder 25 through a bearing 26. The fluid pressure cylinder 25 has a cylinder piston rod. The cylinder piston rod is shortened to store the lid 24 close to the upper horizontal board 13. It is desirable that the lid 24 and the fluid pressure cylinder 25 are removed after the floating structure is towed to a basin point once.

Figure 13:
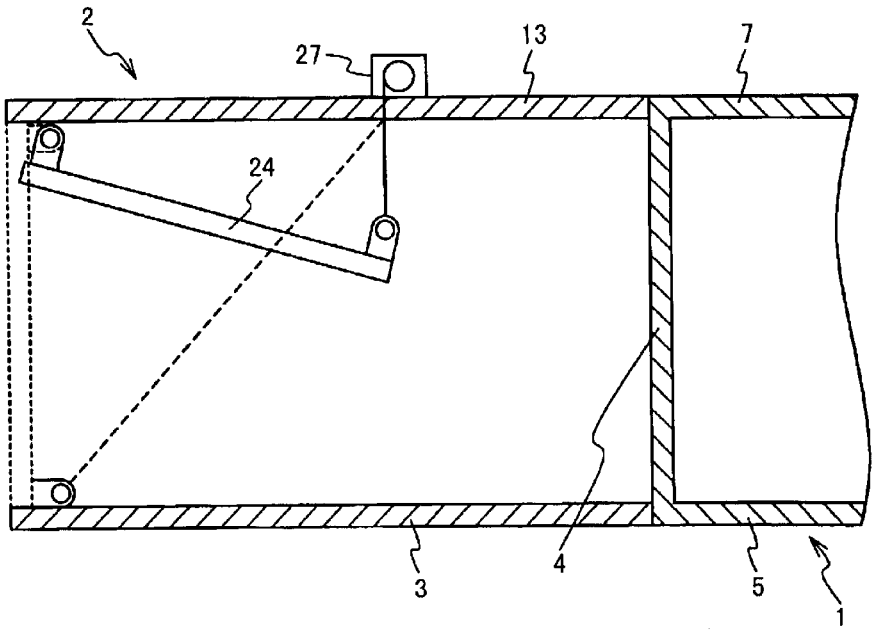
FIG. 13 is a cross sectional view showing a second example of an open and close mechanism of a lid in the motion reduced floating structure according to the fourth modification of the third embodiment of the present invention in case of mooring.

FIG. 13 is a cross sectional view showing a second example of the open and close mechanism of the lid 24. The free end of the same lid 24 as that of FIG. 12 is hung by a winch 27 via a cable.

Figure 14:
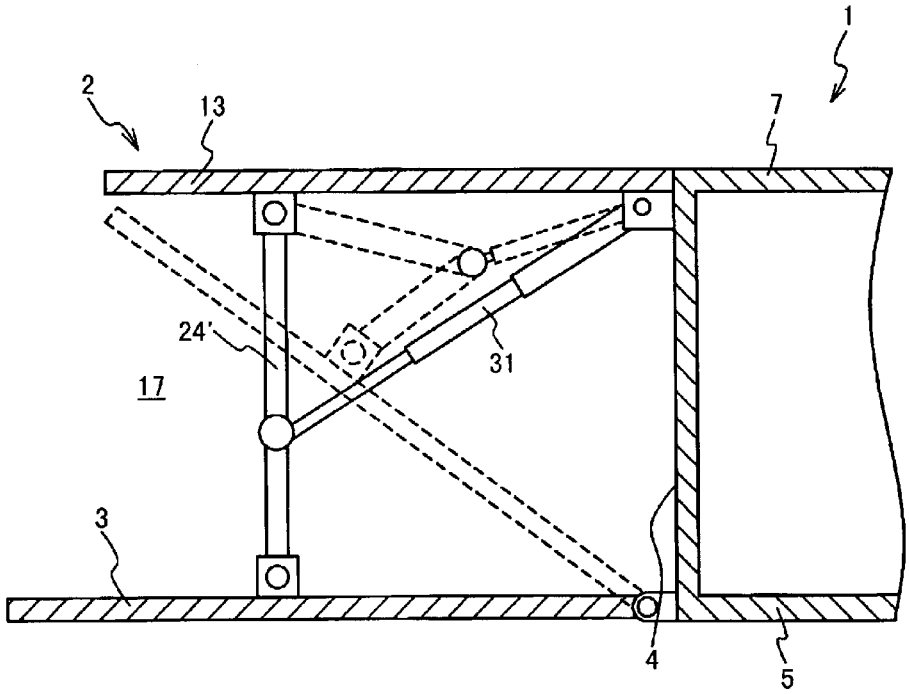
FIG. 14 is a cross sectional view showing a third example of an open and close mechanism of a lid in the motion reduced floating structure according to the fourth modification of the third embodiment of the present invention in case of tow or mooring.

FIG. 14 is a cross sectional view showing a third example of the open and close mechanism of the lid 24 which is used in the third embodiment of the present invention. In the wave damping structure in the third example, the upper horizontal board 13 is formed as an extended portion of the upper horizontal board 7. The horizontal board 3 is formed as an extended portion of the lower horizontal board 5. The lid 24' is interposed between the upper horizontal board 13 and the lower horizontal board 3. The lid 24' is formed in a folding-free manner. The upper portion of the lid 24' is turnably connected with a bearing which is attached to the upper horizontal board 13. The lower portion of the lid 24' is turnably connected with a bearing which is attached to the lower horizontal board 3. The tip portion of a fluid pressure cylinder 31 is connected with a bearing between the upper portion and lower portion in the lid 24'. The proximal end of the fluid pressure cylinder 31 is turnably connected with a bearing which is attached to a portion of the upper horizontal board 13 close to the back board 4. The lower horizontal board 3 is turnably connected with the lower horizontal board 5 of the main hull structure 1. By making an operation medium such as oil or air act on the fluid pressure cylinder 31 to give extension force to the fluid pressure cylinder 31, the lid 24' is pushed against the upper horizontal board 13 and the lower horizontal board 3 such that the lid 24' is firmly fixed between the upper horizontal board 13 and the lower horizontal board 3. With such fixation, the horizontal board 3 is firmly stable on the horizontal plane. On the other hand, by shortening the cylinder rod of the fluid pressure cylinder 31, the lid 24' is folded and the lower horizontal board 3 is lifted up. As a result, the tip portion of the lower horizontal board 3 contacts the lower surface of the upper horizontal board 13, as shown by the dotted line. This state is like the shape of a usual hull and used for towing. Thus, a wave resistance reducing effect is obtained. In case of mooring (in case of use of the floating structure), the wave damping structure of the horizontal boards 3 and 13 and the lid 24' is firmly formed, as shown by the solid line. This example is practical when the mooring position is changed and the number of times of the tow becomes more than one.

Figure 15:
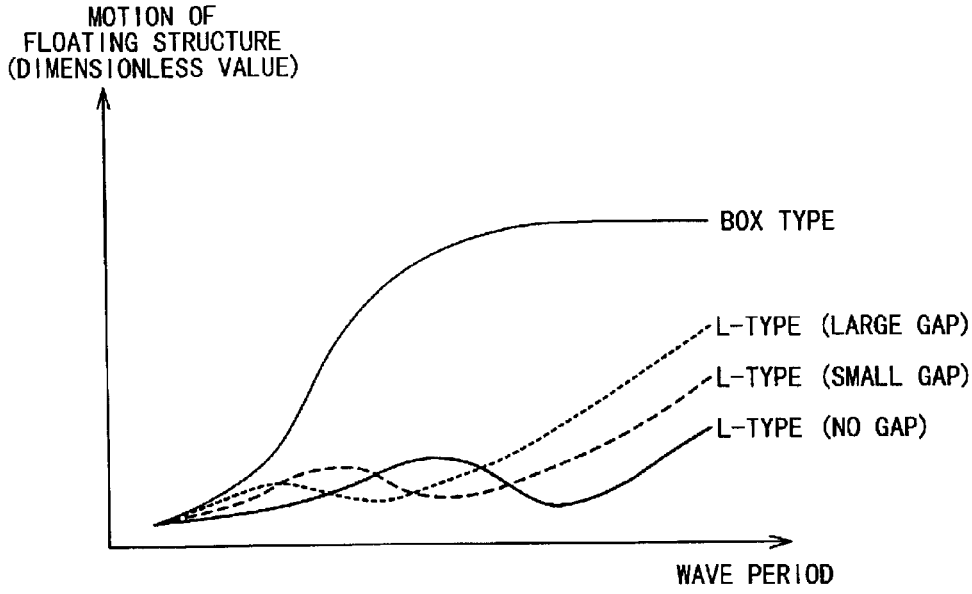
FIG. 15 is a graph showing the motion of the floating structure in a plurality of models.

FIG. 15 shows relation between the wave period and the motion of the main hull structure 1. The value of the rotational motion around the horizontal axis is shown as a dimensionless value with respect to a comparison value. Each graph of FIG. 15 shows the result of a theoretical calculation when the floating structure with the wave damping structure shown in FIG. 1 is used as a model. A simple box-type model (midair flat rectangular parallelepiped) without the wave damping structure is employed as a box-type model. A total area of the large vertical direction seawater passage holes 12 in the L-type large clearance gap model in which is larger than a total area of the vertical direction seawater passage holes 12 in the L-type small clearance gap model. In the L-type gapless model, a total area of the vertical direction seawater passage holes 12 is zero. The rotational motion around the horizontal axis in the box-type model is larger than that of any model in the present invention. The rotational motion around the horizontal axis of the L-type large clearance gap model is larger in a wave period range larger than a specific wave period than the rotational motion around the horizontal axis in the L-type small clearance gap model. The rotational motion around the horizontal axis of the horizontal axis in the L-type small clearance gap model is larger in the wave period region larger than another specific wave period than the rotational motion around the horizontal axis of the L-type gapless model. When attention is paid to only the rotational motion around the horizontal axis, the area of the vertical direction seawater passage holes 12 can be most appropriately set in accordance with the specific wave period.

Figure 16:
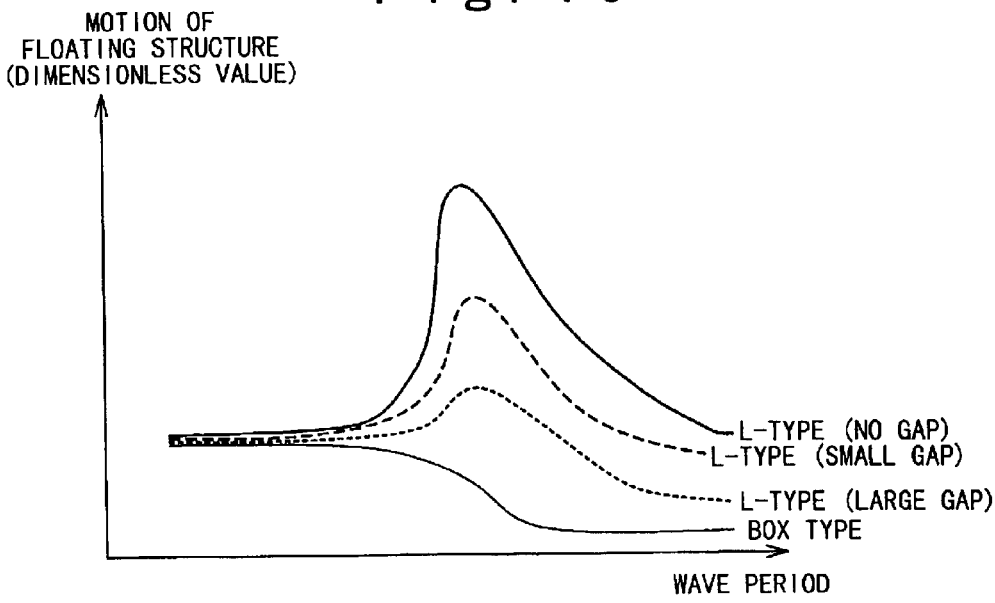
FIG. 16 is a graph showing wave drift force coefficient in the plurality of models.

FIG. 16 shows relation between the wave period and the translational motion in the horizontal direction (corresponding to the wave drift force coefficient). The value of the translational motion in the horizontal direction is compared with a reference value to make it dimensionless. Each graph of FIG. 16 shows a theoretical calculation result carried out about the above-mentioned models. The translational motion in the horizontal direction in the box-type model is smaller than that of any model in the present invention which receives the reaction force of the reflected wave. The translational motion in the horizontal direction in the L-type gapless model is larger over the whole range of wave period than the translational motion in the horizontal direction in the L-type small clearance gap model. The translational motion in the horizontal direction of the L-type small clearance gap model is larger in the whole range of wave period than the translational motion in the horizontal direction of the L-type large clearance gap model. The translational motion in the horizontal direction in the box-type model is small in a range of the long wave period in the period region, and is large in a range of the short wave period, and doesn't have a peak value. The translational motion in the horizontal direction in each of all the models of the present invention has a sharp peak value at each specific wave period.

Figure 17:
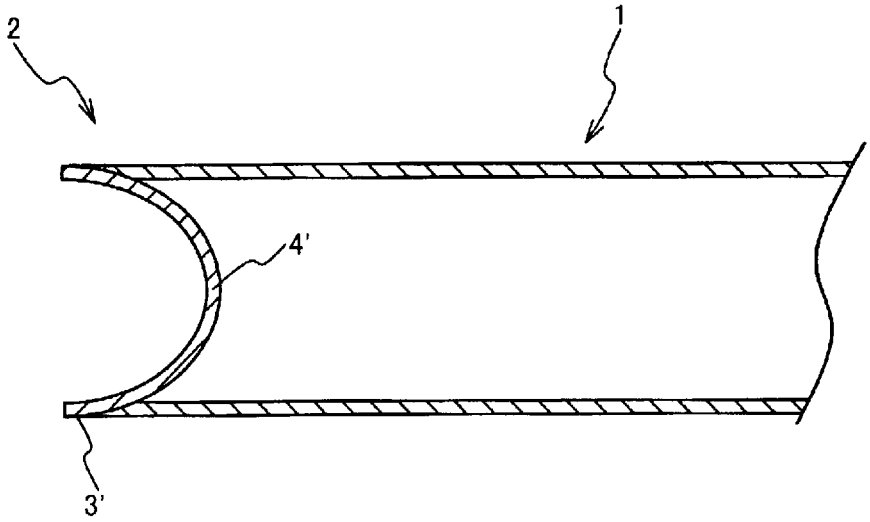
FIG. 17 is a cross sectional view of the motion reduced floating structure according to a fourth embodiment of the present invention.

FIG. 17 shows the motion reduced floating structure according to the fourth embodiment of the present invention. In the fourth embodiment, a hemispherical convex section of the bow structure of the hull as a self-propelled floating structure is changed into a hemispherical concave section structure or inverted hemispherical bow structure. The inside 4' of the hemispherical shape concavity is equivalent to the above-mentioned back board 4 and the hemispherical concavity bottom 3' is equivalent to the horizontal board 3. Such a hemispherical shell structure is excellent in the structural strength. The hemispherical shape concave surface may be changed into a half circular cylinder concave surface.

Figure 18:
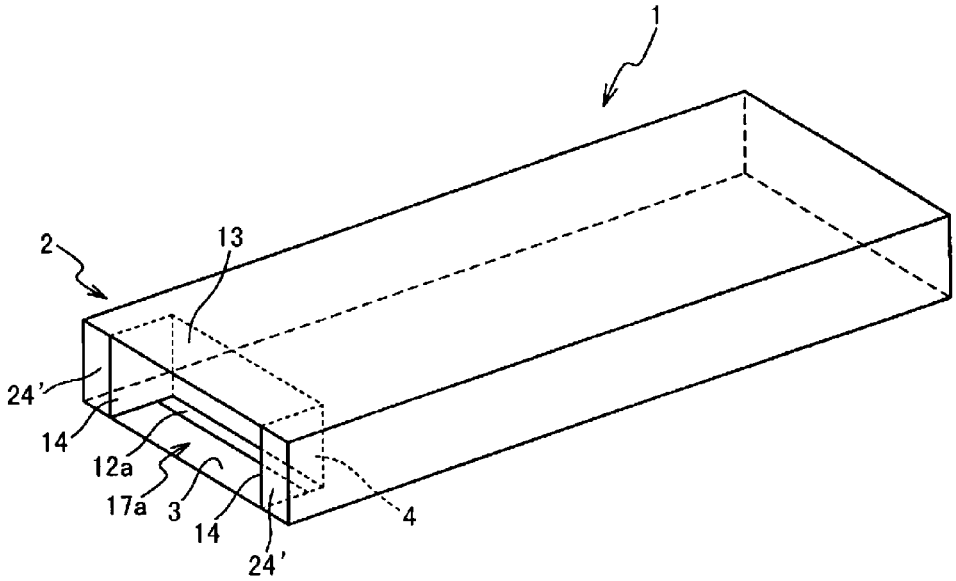
FIG. 18 is a perspective view of the motion reduced floating structure according to a fifth embodiment of the present invention.

FIG. 18 shows the motion reduced floating structure according to the fifth embodiment of the present invention.

In the fifth embodiment, the wave damping structure with a single concave domain 17*a* is formed. The concave domain 17*a* is opened only in the wave progress direction. The concave domain 17*a* is formed of vertical partitioning boards 14 on either side, the back board 4 as the shorter side vertical board 4 of the main hull structure 1, the upper horizontal board 13 extending from the main hull structure 1, and the lower horizontal board 3 extending from the main hull structure 1. A closure board 24' is provided between each of the vertical partitioning boards 14 and the outermost board in either side. The vertical direction seawater passage hole 12*a* is arranged on a portion of the lower horizontal board 3 close to the back board 41. The wave incident on the upper side of the horizontal board 3 cannot run away from the sides of the concave domain 17*a* and is reflected to reduce rotational motion around the horizontal axis.

Figure 19:
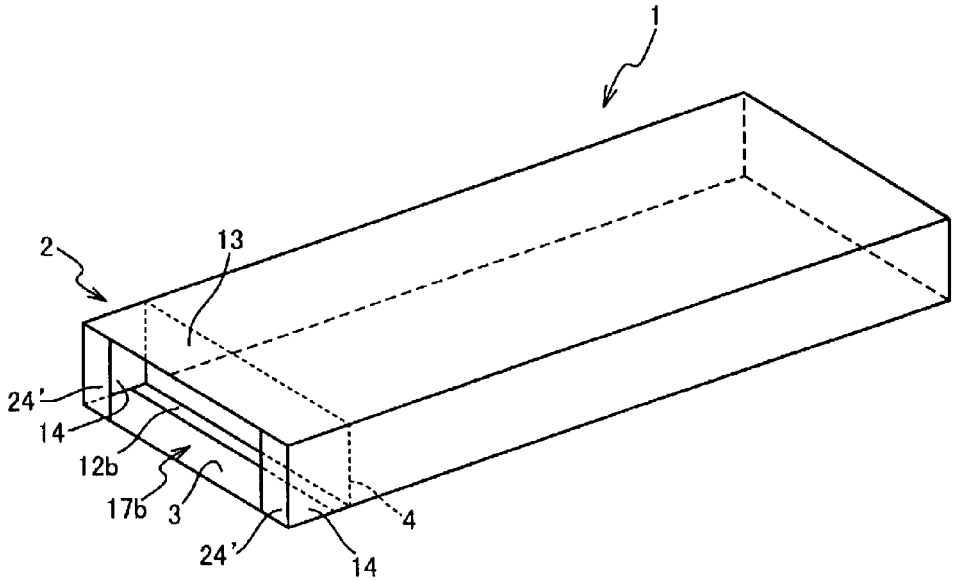
FIG. 19 is a perspective view of the motion reduced floating structure according to a first modification of the fifth embodiment of the present invention.

Both of the vertical petitioning boards 14 may have holes and in an especial case, may be omitted, as shown in FIG. 19. The entrance width of a concave domain 17*b* in the lateral direction shown in FIG. 19 is narrower than the inside width of the concave domain 17*b* in the lateral direction. The wave damping structure 2 with the domain 17*b* is composed of the upper horizontal board 13 extending from the main hull structure 1, the vertical partitioning boards 4 extending from the main hull structure 1, the lower horizontal board 3 extending from the main hull structure 1, and front closure boards 24'.

In the first modification of the fifth embodiment of FIG. 19, the wave damping structure of the inverted L-type structure may be formed by removing the lower horizontal board 3. The wave goes around on the back side of the front closure boards 24' to achieve the composite effect of the L-type structure and the inverted L-type structure and the motion is reduced with better balance. Compared with the above-mentioned embodiment in which the L-type structure is added to the center portion in the wave progress direction, energy of the wave running away to the side is less, and the reduction effect is larger that the rotational motion around the horizontal axis. By the wave acting on the back vertical board 4 in the inverted L-type structure, the suppression effect of the translational motion in the horizontal direction is larger compared with the embodiment of FIG. 18. If a hole 12 is provided for the horizontal board 3, the motion in the horizontal direction is more suppressed.

Figure 20:
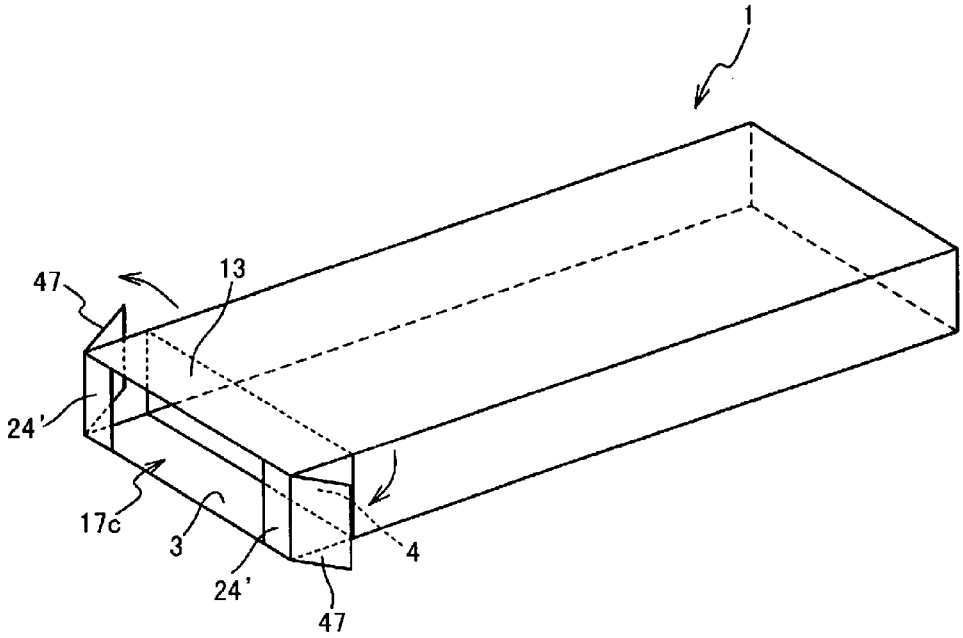
FIG. 20 is a perspective view of the motion reduced floating structure according to a second modification of the fifth embodiment of the present invention.

Moreover, the first modification of FIG. 19 can be modified, as the second modification shown in FIG. 20. In the second modification of FIG. 20, both of the vertical partitioning boards 14 as the outermost side boards which forms the concave domain 17*b* of the embodiment of FIG. 19 are cut, are diagonally bent to the wave progress direction and are re-formed as wave reflection boards 47. Such an opening is a substitution of the inverted L-type structure of the FIG. 19 and decreases the translational motion in the horizontal direction. The wave reflection boards 47 reflect the wave in the lateral direction symmetrically and achieve the above-mentioned effect.

Figure 21:
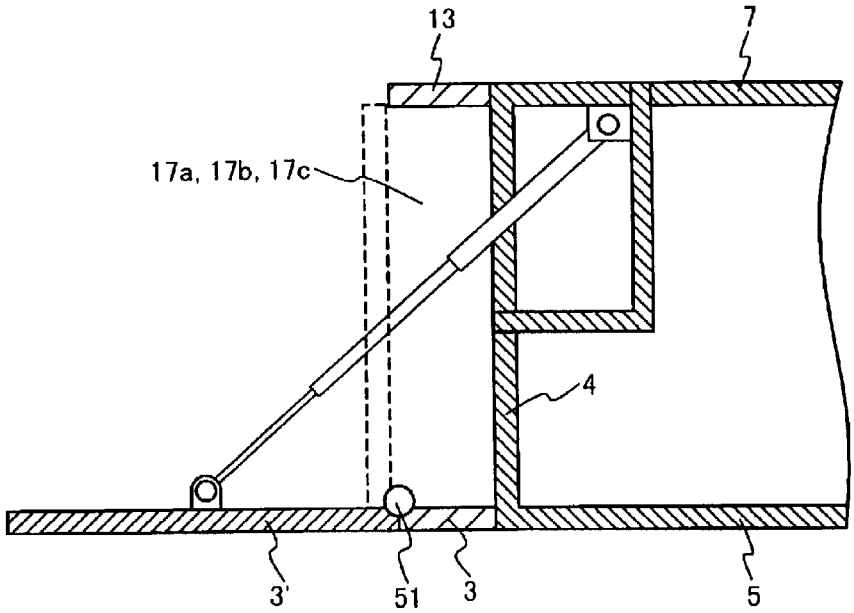
FIG. 21 is a cross sectional view showing a first example of an open and close mechanism in the motion reduced floating structure according to the fifth embodiment of the present invention.

FIG. 21 shows the motion reduced floating structure according to a first example of an open and close mechanism in the motion reduced floating structure according to the fifth embodiment of the present invention. In this example, the examples of FIGS. 18 to 20 are more improved. In the examples of FIGS. 18*b* to 20, the concave domain is formed using the original boards of the main hull structure. In this example, an auxiliary horizontal board 3' is added. The auxiliary horizontal board 3' is extended and attached to the tip portion of the horizontal board 3 in the wave progress direction through a hinge 51. The proximal end of a hydraulic pressure cylinder on the side of the main hull structure is turnably supported on the ceiling inside the main hull structure 1. The free end of the hydraulic pressure cylinder is turnably supported by the center of the auxiliary horizontal board 3'. The auxiliary horizontal board 3' is opened and closed through the operation of the hydraulic pressure cylinder, and insulates the concave domains 17*a*, 17*b*, and 17*c* from the seawater in the position in which the auxiliary horizontal board 3 is closed, and stands up in case of tow. Moreover, the auxiliary horizontal board 3' is opened in case of mooring to extend the horizontal board 3 to a proper length in the wave progress direction.

Figure 22:
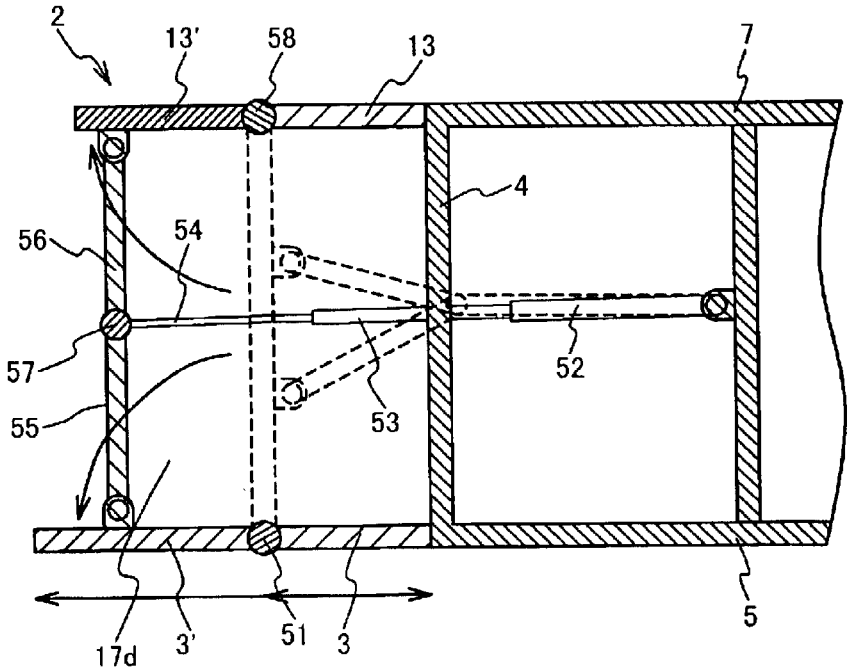
FIG. 22 is a cross sectional view showing a second example of an open and close mechanism in the motion reduced floating structure according to the fifth embodiment of the present invention.

FIG. 22 shows the open and close mechanism in the motion reduced floating structure according to the second example of the fifth embodiment of the present invention. In this example, an auxiliary horizontal board 13' is added to extend from the upper horizontal board 13 shown in FIG. 2 in addition to the auxiliary horizontal board 3'. The hydraulic pressure cylinder is comprised of a first stage cylinder 52 extendable in the horizontal direction, a second stage cylinder 53 extendable from the first stage cylinder 52, and an extendable rod 54 for the second stage cylinder 53. Two links 55 and 56 are turnably branched through a hinge 57 at the tip portion of the extendable rod 54. The other ends of the two links 55 and 56 are turnably connected with proper portions of the auxiliary horizontal board 3' and auxiliary horizontal board 13'. The auxiliary horizontal board 13' is turnably connected through a hinge 58. The auxiliary horizontal board 3' is turnably connected through a hinge 51.

If the second stage cylinder 53 and the extendable rod 54 are dragged into the first stage cylinder 52, the hinge 57 retreats to the horizontal direction, so that the auxiliary horizontal board 3' and the auxiliary horizontal board 13' are turned 90 degrees. As a result, the tip portion of the auxiliary horizontal board 3' and the tip portion of the auxiliary horizontal board 13' mate to each other on one horizontal plane as shown in the figure by the dotted line. The concave domain is closed in case of tow. In this example, the concave domains 17*d* is formed of structural members on the upper and lower sides. The structure member on the upper side is formed of the horizontal board 13 and the auxiliary horizontal board 13', and the structure member on the lower side is formed of the horizontal board 3 and the auxiliary horizontal board 3'. The extended length by the addition of the auxiliary horizontal board 3' and the auxiliary horizontal deck 13' is freely designed.

If the clearance gap of the vertical direction seawater passage hole 12 becomes large, the translational motion in the horizontal direction becomes small in the whole wave period range like a usual hull. The roll motion around the horizontal axis becomes small in the range of a shorter wave period. If a total area of the vertical direction seawater passage holes 12 is adjusted in accordance with the wave period, it is possible to reduce the translational motion in the horizontal direction and the rotational motion around the horizontal axis simultaneously over the whole wave period range, while the translational motion in the horizontal direction and the rotational motion around the horizontal axis are made balanced. In the wave period range where the translational motion in the horizontal direction becomes large, it is desirable that the embodiments of FIGS. 6, 7 and 8 which form the concave domain with high reflectability in the lateral direction are adopted.

In the motion reduced floating structure according to the present invention, the concave section is formed using a part of the floating structure. Therefore, the wave damping structure can be lightened. By providing hole(s) for the horizontal board, it is possible to balance two kinds of motion. The existence of the reinforcement members provided in case of the formation of the hole is effective.

What is claimed is:

1. A motion reduced floating structure comprising:

a main hull structure; and a wave damping structure connected with said main hull structure.

said wave damping structure comprising:

a back board connected with said main hull structure;

an upper horizontal board connected with an upper portion of the back board and extending in a horizontal direction, the upper horizontal board adapted to prevent a flow of seawater through the upper horizontal board;

a lower horizontal board connected with a lower portion of said back board and extending in a horizontal direction; and vertical members connected with said lower horizontal board, said upper horizontal board and said back board, wherein said vertical members comprise three vertical members defining two volumes among the vertical members and the upper and lower horizontal boards.

2. The motion reduced floating structure according to claim 1, wherein said lower horizontal board defines a through hole adapted to permit a flow of seawater through the lower horizontal board, the through hole extending an entire length of the lower horizontal board.

3. A motion reduced floating structure comprising:

a main hull structure; and a wave damping, structure connected with said main hull structure;

said wave damping structure comprising:

a back board connected with said main hull structure;

an upper horizontal board connected with an upper portion of the back board and extending in a horizontal direction, the upper horizontal board adapted to prevent a flow of seawater through the upper horizontal board;

a lower horizontal board connected with a lower portion of said back board and extending in a horizontal direction; and two vertical members connected with said upper horizontal board, said lower horizontal board and said back board, wherein said two vertical members are connected with said upper horizontal board, said lower horizontal board and said back board at end portions of the boards.

4. The motion reduced floating structure according to claim 3, wherein at least one of said two vertical members comprises a first portion connecting to the boards and a second portion extending at an angle from the first portion, the second portion defining an opening among the vertical member and the boards.

5. The motion reduced floating structure according to claim 3, wherein said wave damping structure further comprises:

a front vertical board connected to said upper horizontal board, said lower horizontal board and at least one of the vertical members, the front vertical board extending in a same direction as and offset from the back board.

* * * * *